United States Patent [19]

Shin-Seng

[11] Patent Number: 4,792,014

[45] Date of Patent: Dec. 20, 1988

[54] TAIL PIPE FOR DRAFTING ENGINE EXHAUST GAS

[76] Inventor: Lin Shin-Seng, No. 48, Alley 34, Lane 165, Chung-San E. Rd., Sec. 3, Chung-Li City, Taoyuan Hsien, Taiwan

[21] Appl. No.: 138,646

[22] Filed: Dec. 24, 1987

[51] Int. Cl.[4] ..... F01N 1/12; F01N 1/14

[52] U.S. Cl. ..... 181/280; 181/227; 181/251; 181/255; 181/263

[58] Field of Search ..... 181/227, 228, 247≧251, 181/255, 262, 263, 267, 268, 274, 275, 279, 280

[56] References Cited

U.S. PATENT DOCUMENTS

| | | | |
|---|---|---|---|
| 1,027,469 | 5/1912 | Forney | 181/263 |
| 1,377,472 | 5/1921 | Gibson | 181/263 |
| 1,577,775 | 3/1926 | Templeton | 181/227 |
| 4,331,213 | 5/1982 | Taniguchi | 181/263 |
| 4,361,206 | 11/1982 | Tsai | 181/255 |

*Primary Examiner*—B. R. Fuller

[57] ABSTRACT

A tail pipe for drafting an engine exhaust gas includes: a front perforated pipe connected to an engine exhaust silencer or muffler, an outer pipe jacketed outside the front pipe for leading environmental air therein, a central pipe connected on a rear end portion of the front pipe and disposed inside the outer pipe, and plural swirl perforated plates each helically secured between the central pipe and the outer pipe and each swirl plate securing the rear portion of the front pipe between the outer pipe and the central pipe, whereby upon a discharge of an engine exhaust gas, the pressure of a partial exhaust gas stream is reduced by the induced environmental cooling air and the pressure of the remaining gas stream is further reduced since the gas stream is guided through the swirl perforated plates to exert an eddy flow at the pipe exit to strongly suck the exhaust gas outwardly.

3 Claims, 2 Drawing Sheets

TAIL PIPE FOR DRAFTING ENGINE EXHAUST GAS

BACKGROUND OF THE INVENTION

A conventional muffler connected to an exhaust pipe of an internal combustion engine as shown in FIG. 6 includes: an expansion chamber EC, a resonating chamber R and several perforated pipes P enclosed with glass fibers or other sound-wave absorbing materials R for noise silencing purpose. However, an engine exhaust gas, before leaving from such a muffler, will flow through the perforated pipes to delay its discharge movement and to cause back pressure against an engine cylinder, thereby resulting in an incomplete combustion of gas mixture inside the engine and counteracting the engine output.

The present inventor has found these phenomena and invented the present tail pipe for drafting an engine exhaust gas.

SUMMARY OF THE INVENTION

The object of the present invention is to provide a tail pipe including a front perforated pipe connected to an engine exhaust silencer or muffler, an outer pipe jacketed outside the front pipe for leading environmental air therein, a central pipe connected with a rear end portion of the front pipe and disposed inside the outer pipe, and plural swirl perforated plates each helically secured between the central pipe and the outer pipe and each swirl plate securing the rear portion of the front pipe between the outer pipe and the central pipe, whereby upon a discharge of an engine exhaust gas, the pressure of a partial exhaust gas stream is reduced by the induced environmental cooling air and the pressure of the remaining gas stream is further reduced since the gas stream is guided through the swirl perforated plates to exert an eddy flow at the pipe exit to strongly suck the exhaust gas outwardly.

DETAILED DESCRIPTION

Figure 1:
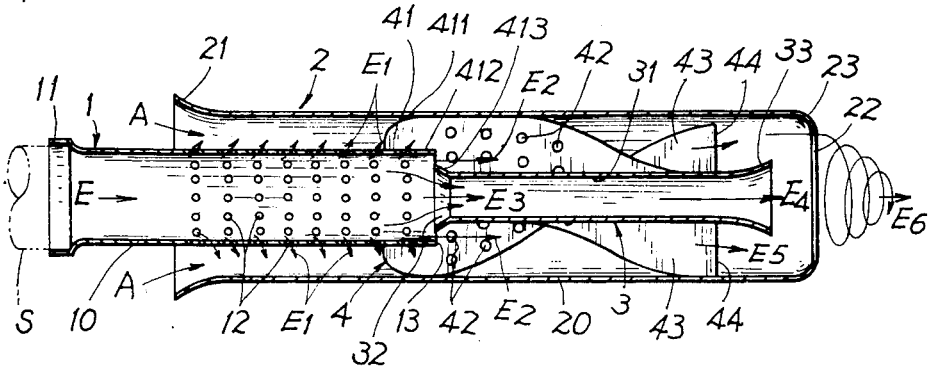
FIG. 1 is a front-view illustration of the present invention.
Figure 2:
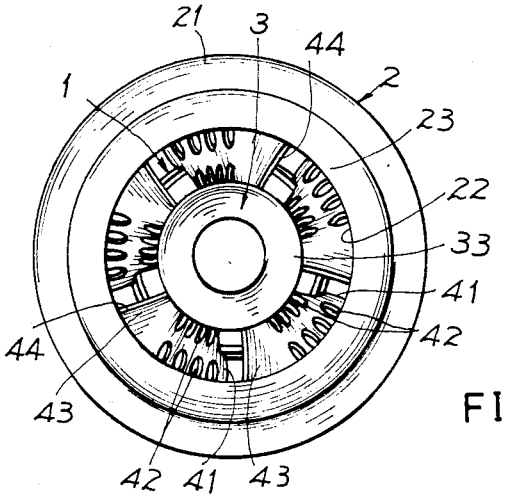
FIG. 2 is a right-side view of the present invention.
Figure 3:
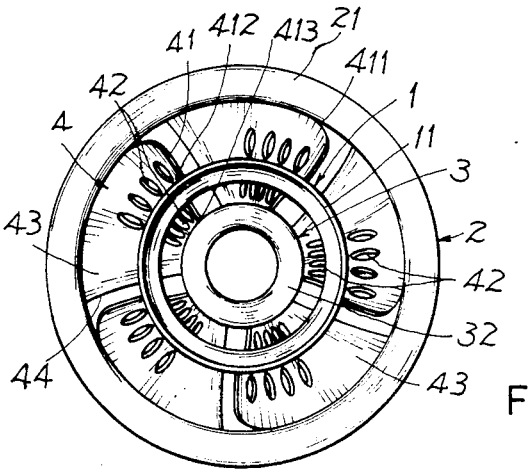
FIG. 3 is a left-side view of the present invention.

As shown in FIGS. 1–5, the present invention comprises: a front pipe 1, an outer pipe 2, a central pipe 3 and plural swirl plates 4.

The front pipe 1 includes a cylindrical hollow pipe portion 10 having its middle and rear portions drilled with plural perforations 12 therethrough and having the pipe portion 10 disposed inside the outer pipe 2, a front opening end 11 adapted for connecting an exhaust silencer pipe S of a car or a motorcyle, and a rear end opening 13 followed by the central pipe 3. The diameter of front pipe 1 is smaller than that of the outer pipe 2, but larger than the diameter of the central pipe 3.

The outer pipe 2 includes a cylindrical hollow pipe portion 20 jacketed outside a partial portion of the front pipe 1 and the central pipe 3, a front trumpet flange 21 expanding frontwardly from the pipe 20 to form an air inlet hood, a rear gas-exit opening 22 having diameter smaller than that of the pipe portion 20, and a rear contraction edge 23 arcuately formed on a rear end of the pipe portion 20 to define the rear opening 22.

The central pipe 3 includes: a cylindrical hollow pipe portion 31, a front expansion edge 32 slightly expanding frontwardly from the front end of the pipe portion 31 to follow the rear opening 13 of the front pipe 1, and a rear trumpet portion 33 expanding rearwardly from the rear end of pipe portion 31 proximate to the rear opening 22 of outer pipe 2. The front end of pipe 3 can also be made as a flat edge 32*a* directly following the rear opening of the front pipe 1 as shown in FIG. 5.

Figure 4:
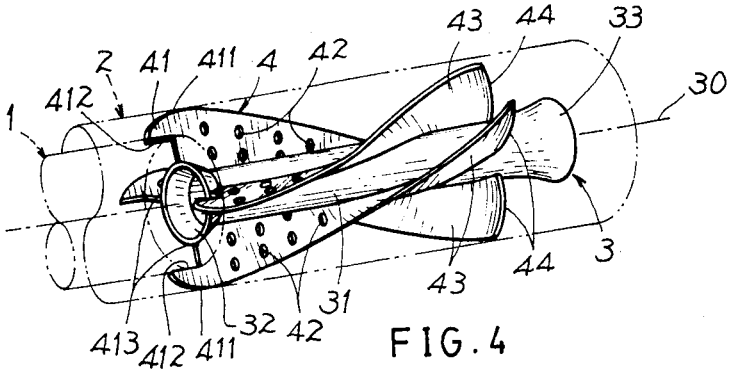
FIG. 4 is a perspective illustration showing the central pipe and the swirl plates of the present invention.

Each swirl plate 4 is helically secured between the outer pipe 2 and the central pipe 3 along a longitudinal axis 30 of the central pipe 3 especially as shown in FIG. 4. Each swirl plate 4 includes a front L-shaped fin 41 having the outer edge 411 of the fin secured to the outer pipe 2, the intermediate edge 412 securing a rear portion of the front pipe 1 between the outer pipe 2 and the central pipe 3 and the central edge 413 secured to the central pipe 3. The front portion of each plate 4 is formed with plural perforations 42 therethrough, but the rear portion 43 of the plate 4 is not drilled. The rear end portion is positioned proximate to the rear trumpet portion 33 of central pipe 3. The number of the swirl plates 4 is not limited in this invention and can be formed as five plates as shown in the figures.

Figure 5:
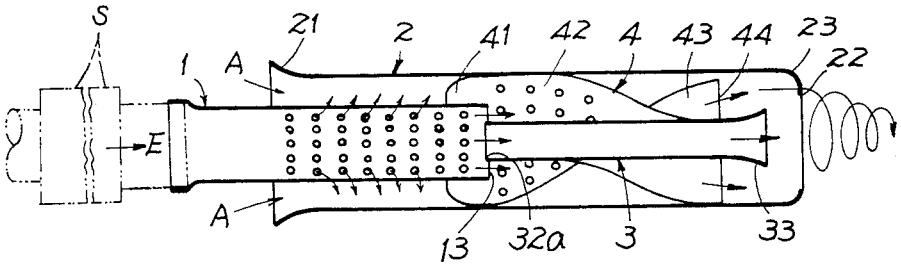
FIG. 5 is an illustration showing an application of the present invention.
Figure 6:
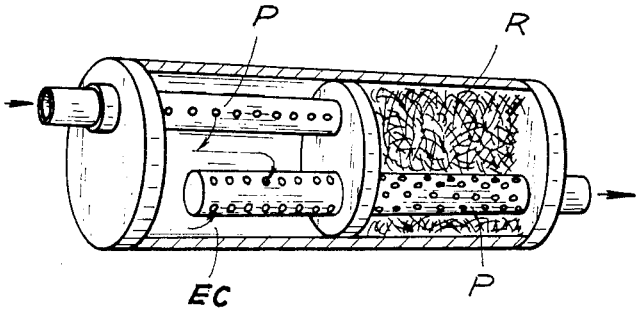
FIG. 6 PRIOR ART
FIG. 6 shows a conventional muffler of a car combustion engine.

In operating the tail pipe of the present invention as shown in FIGS. 1 and 5, the engine exhaust gas E is discharged through the exhaust silencer S into the front pipe 1 wherein the main exhaust gas stream E will be dissipated into several partial streams as follows:

1. A partial side stream E1 of exhaust gas is discharged into an annular space defined between the outer pipe 2 and the front pipe 1 to mix the inlet air A as drafted through front trumpet flange 21 to reduce the gas temperature and reduce the pressure of exhaust gas E1.

2. The exhaust gas stream passing through the front pipe 1 will be dissipated into an outer annular gas stream E2 directly flowing into the passages as defined between every two neighboring swirl plates 4, and a central gas stream E3 which is contracted from the larger front pipe 1 into the narrower central pipe 3 to be a central stream E4 which is then discharged from the enlarged trumpet portion 33. The central stream (E3 to E4) will cause great reduction of gas pressure due to converging-diverging friction loss.

3. The side stream E1 (between outer pipe 2 and front pipe 1) and an intermediate stream E2 (between the front pipe 1 and the central pipe 3) are commonly directed into the swirl plates 4 by the pressure exerting on the exhaust gas stream to discharge at the ends of the plates 44 to form eddy flow which is convergently discharged through the rear contraction edge 23 and rear opening 22 to draft the central stream E4 as a combined final discharge stream E6 with great reduction of gas pressure.

4. The front portion of each swirl plate 4 is drilled with perforations 42 to enhance a better mixing of exhaust gas stream with inlet air (E1+E2+A) for reducing the temperature and pressure of the exhausting gas mixture.

From the above-mentioned analysis, the present invention may reveal the following advantages to compensate the drawbacks as found in a conventional vehicle exhaust silencer:

1. Since the gas pressure is greatly reduced by the forced draft of the discharge gas and an induction of inlet cooling air, the high pressure inside the silencer chamber or tube will be effectively released by the present tail pipe to evacuate the waste gas and carbon in an engine cylinder for complete engine combustion, and to prevent any back pressure counteracting the engine output.

2. The inlet air as induced into the tail pipe will dilute the pollutant concentration in the exhaust gas to ensure a sound allowable concentration meeting waste-gas emission standard for the prevention of air pollution.

3. The final exhaust gas stream as sprayed by the swirl plates 4 and the converging-diverging pipes (1, 3, 23) will exert a thrust force acting upon an environmental air to further help drive a car or a motorcyle.

4. Due to more complete combustion of the engine, the fuel oil can be efficiently consumed for energy-saving purpose. The carbon as accumulated in the cylinder and the silencer will also be effectively removed to thereby prolong the service life of a plug and the silencer.

If for further precluding the noise from the present invention, an outermost pipe (not shown) can be further jacketed outside the outer pipe 2 to be filled with sound-wave absorber such as glass fiber to eliminate the possible noise coming therefrom.

I claim:

1. A tail pipe for drafting engine exhaust gas comprising:

a front pipe formed as a cylindrical hollow pipe portion having a front opening end secured to an engine exhaust silencer, having a middle and rear portion of the cylindrical hollow pipe portion drilled with plural perforations therethrough;

an outer pipe formed as a cylindrical hollow pipe portion having a diameter larger than that of said front pipe jacketed outside said middle and rear portion of said front pipe, having a front trumpet flange expanding frontwardly from a front end of said outer pipe, and a rear contraction edge arcuately formed on a rear end of said outer pipe to define a rear opening thereof;

a central pipe having a diameter smaller than that of said front pipe following a rear end opening of said front pipe, having a rear trumpet portion formed on a rear end of said central pipe proximate to the rear opening of said outer pipe; and plural swirl plates helically secured between the central pipe and the outer pipe along a longitudinal axis of said central pipe, each swirl plate having a front L-shaped fin formed on a front end of each said swirl plate securing the rear portion of said front pipe between said outer pipe and said central pipe, whereby upon a discharge of an engine exhaust gas into said front pipe, the exhaust gas is dissipated into a first side stream discharged through said perforations of said front pipe into an annular space defined between said outer pipe and said front pipe, a central steam is rearwardly directed into said central pipe for a converging-diverging flow and an intermediate stream including an annular flow of the first side stream is directed into the swirl plates forming an eddy flow to draft the central stream for efficiently releasing the exhaust gas from the engine silencer and cylinder.

2. A tail pipe according to claim 1, wherein said swirl plate is drilled with plural perforations on a front portion thereof.

3. A tail pipe according to claim 1, wherein said central pipe is formed with a front expansion edge slightly expanding frontwardly from the front end of said central pipe to follow the rear end opening of said front pipe.

* * * * *